US011017923B1

(12) United States Patent
Ryu et al.

(10) Patent No.: US 11,017,923 B1
(45) Date of Patent: May 25, 2021

(54) RESISTOR COMPONENT

(71) Applicant: SAMSUNG ELECTRO-MECHANICS CO., LTD., Suwon-si (KR)

(72) Inventors: Heung Bok Ryu, Suwon-si (KR); Yeon Hee Shin, Suwon-si (KR); Ji Sook Yoon, Suwon-si (KR); Dong Woo Kim, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 0 days.

(21) Appl. No.: 16/900,328

(22) Filed: Jun. 12, 2020

(30) Foreign Application Priority Data

Dec. 12, 2019 (KR) ..... 10-2019-0165450

(51) Int. Cl.

| | |
|---|---|
| ***H01C 1/14*** | (2006.01) |
| ***H01C 17/28*** | (2006.01) |
| ***H01C 1/02*** | (2006.01) |
| ***H01C 1/012*** | (2006.01) |

(52) U.S. Cl.
CPC ..... *H01C 1/14* (2013.01); *H01C 1/012* (2013.01); *H01C 1/02* (2013.01); *H01C 17/281* (2013.01)

(58) Field of Classification Search
CPC . H01C 1/14; H01C 1/012; H01C 1/02; H01C 17/281
See application file for complete search history.

(56) References Cited

U.S. PATENT DOCUMENTS 3,964,087 A * 6/1976 Mallon ..... H05K 3/3405 338/306
4,486,738 A * 12/1984 Sadlo ..... H01C 17/006 219/543
4,788,523 A * 11/1988 Robbins ..... H01C 17/006 29/412
6,005,474 A * 12/1999 Takeuchi ..... H01C 1/142 338/320

(Continued)

FOREIGN PATENT DOCUMENTS

JP H07-183108 A 7/1995
JP 2006-19323 A 1/2006

OTHER PUBLICATIONS

JP H07-183108, Tamaki et al., machine translation. (Year: 1995).*

*Primary Examiner* — Kyung S Lee
(74) *Attorney, Agent, or Firm* — Morgan, Lewis & Bockius LLP

(57) ABSTRACT

A resistor component includes an insulating substrate having one surface and the other surface and one end surface and the other end surface, a slit portion disposed on the one end surface and the other end surface and extending to the one surface and the other surface, a resistor layer disposed on the one surface, and a first terminal and a second terminal connected to the resistor layer. The first and second terminals include: an internal electrode layer including an upper electrode disposed on the one surface, a lower electrode disposed on the other surface, and a slit electrode disposed on an internal wall of the slit portion, and an external electrode layer disposed on the one end surface, the other end surface, and the internal wall of the slit portion, being in contact with the slit electrode, having a thickness less than a thickness of the internal electrode layer.

20 Claims, 12 Drawing Sheets

(56) References Cited

U.S. PATENT DOCUMENTS

| | | | | |
|---|---|---|---|---|
| 9,396,849 | B1 * | 7/2016 | Wyatt | H01C 17/28 |
| 10,332,660 | B2 * | 6/2019 | Lee | H01C 7/003 |
| 2003/0005576 | A1 * | 1/2003 | Tsukada | H01C 17/006<br>29/619 |
| 2006/0132277 | A1 * | 6/2006 | Hetherton | H01C 7/027<br>336/232 |

* cited by examiner

II - II'

RESISTOR COMPONENT

CROSS-REFERENCE TO RELATED APPLICATION(S)

This application claims benefit of priority to Korean Patent Application No. 10-2019-0165450 filed on Dec. 12, 2019 in the Korean Intellectual Property Office, the disclosure of which is incorporated herein by reference in its entirety.

TECHNICAL FIELD

The present disclosure relates to a resistor component.

BACKGROUND

A resistor component is a passive electronic component for implementing a precision resistor. A resistor component may adjust a current and may increase and decrease a voltage in an electronic circuit.

As electronic devices have been designed to have a reduced size and a precise design, a size of an electronic circuit employed in electronic devices has been reduced, and a size of a resistor component has also been reduced. Recently, to reduce costs and time for producing a resistor component, various measures have been suggested to reduce the number of manufacturing processes.

SUMMARY

An aspect of the present disclosure is to provide a resistor component having improved cohesion reliability with a mounting substrate.

Another aspect of the present disclosure is to provide a resistor component which may improve efficiency of manufacturing processes.

According to an aspect of the present disclosure, a resistor component includes an insulating substrate having one surface and the other surface opposing each other and one end surface and the other end surface connecting the one surface and the other surface to each other and opposing each other, a slit portion disposed on the one end surface and the other end surface of the insulating substrate and extending to the one surface and the other surface of the insulating substrate, a resistor layer disposed on the one surface of the insulating substrate, and a first terminal and a second terminal connected to the resistor layer. The first and second terminals include: an internal electrode layer including an upper electrode disposed on the one surface of the insulating substrate, a lower electrode disposed on the other surface of the insulating substrate, and a slit electrode disposed on an internal wall of the slit portion and connecting the upper electrode and the lower electrode to each other, and an external electrode layer disposed on the one end surface of the insulating substrate, the other end surface of the insulating substrate, and the internal wall of the slit portion, in contact with the slit electrode, having a thickness less than a thickness of the internal electrode layer.

According to an aspect of the present disclosure, a resistor component includes an insulating substrate having one surface and the other surface opposing each other, and one end surface and the other end surface connecting the one surface and the other surface to each other and opposing each other; first and second slit portions disposed at the one end surface and the other end surface of the insulating substrate, respectively, and each extending to the one surface and the other surface of the insulating substrate; a resistor layer disposed on the one surface of the insulating substrate; and a first terminal and a second terminal connected to the resistor layer, respectively. The first terminal include: a first internal electrode layer including a first upper electrode disposed on the one surface of the insulating substrate, a first lower electrode disposed on the other surface of the insulating substrate, and a first slit electrode disposed on an internal wall of the first slit portion and connecting the first upper electrode and the first lower electrode to each other; and a first external electrode layer disposed on the one end surface of the insulating substrate and covering the first slit electrode. The second terminal include: a second internal electrode layer including a second upper electrode disposed on the one surface of the insulating substrate, a second lower electrode disposed on the other surface of the insulating substrate, and a second slit electrode disposed on an internal wall of the second slit portion and connecting the second upper electrode and the second lower electrode to each other; and a second external electrode layer disposed on the other end surface of the insulating substrate and covering the second slit electrode. Among the one surface of the insulating substrate, the other surface of the insulating substrate, and the one end surface of the insulating substrate, the first external electrode layer is disposed on only the one end surface of the insulating substrate. Among the one surface of the insulating substrate, the other surface of the insulating substrate, and the other end surface of the insulating substrate, the second external electrode layer is disposed on only the other end surface of the insulating substrate.

BRIEF DESCRIPTION OF DRAWINGS

The above and other aspects, features, and advantages of the present disclosure will be more clearly understood from the following detailed description, taken in conjunction with the accompanying drawings, in which.

DETAILED DESCRIPTION

Figure 1:
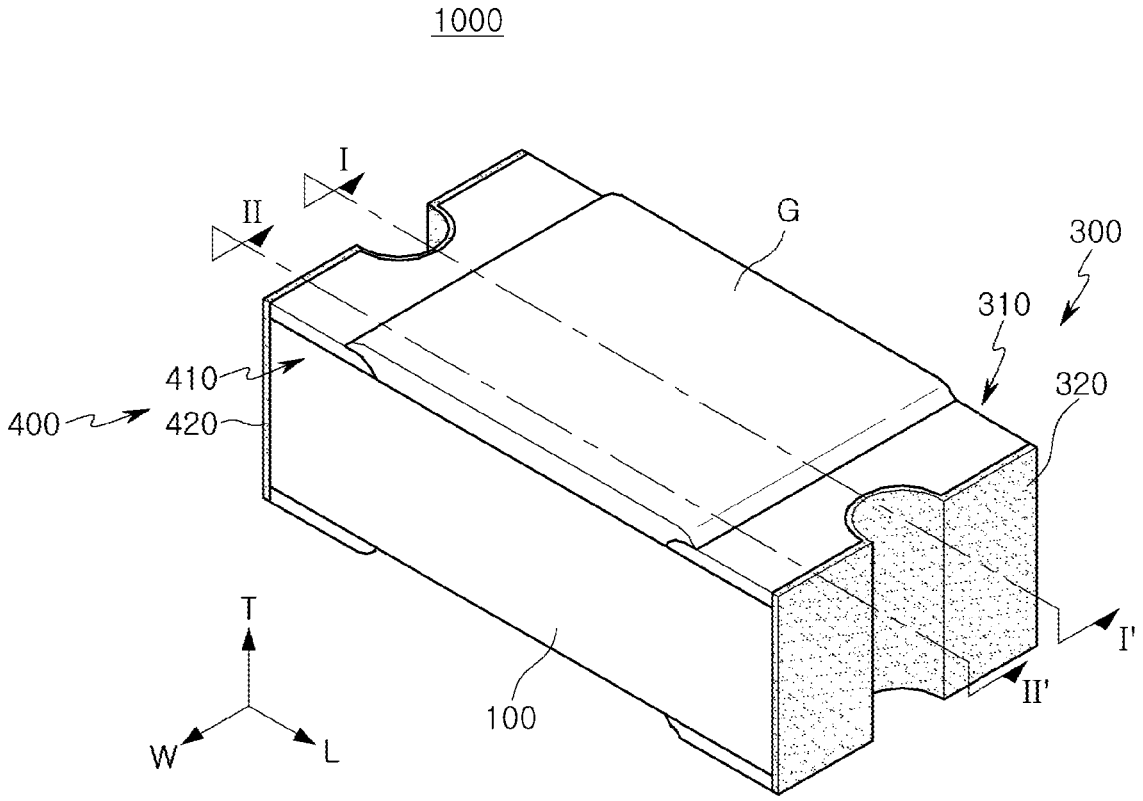
FIGS. 1 and 2 are diagrams illustrating a resistor component according to an example embodiment of the present disclosure.

Hereinafter, embodiments of the present disclosure will be described as follows with reference to the attached drawings.

The terms used in the exemplary embodiments are used to simply describe an exemplary embodiment, and are not intended to limit the present disclosure. A singular term includes a plural form unless otherwise indicated. The terms, "include," "comprise," "is configured to," etc. of the description are used to indicate the presence of features, numbers, steps, operations, elements, parts or combination thereof, and do not exclude the possibilities of combination or addition of one or more features, numbers, steps, operations, elements, parts or combination thereof. Also, the term "disposed on," "positioned on," and the like, may indicate that an element is positioned on or beneath an object, and does not necessarily mean that the element is positioned on the object with reference to a gravity direction.

The term "coupled to," "combined to," and the like, may not only indicate that elements are directly and physically in contact with each other, but also include the configuration in which the other element is interposed between the elements such that the elements are also in contact with the other component.

Sizes and thicknesses of elements illustrated in the drawings are indicated as examples for ease of description, and exemplary embodiments in the present disclosure are not limited thereto.

A value used to describe a parameter such as a 1-D dimension of an element including, but not limited to, "length," "width," "thickness," diameter," "distance," "gap," and/or "size," a 2-D dimension of an element including, but not limited to, "area" and/or "size," a 3-D dimension of an element including, but not limited to, "volume" and/or "size", and a property of an element including, not limited to, "roughness," "density," "weight," "weight ratio," and/or "molar ratio" may be obtained by the method(s) and/or the tool(s) described in the present disclosure. The present disclosure, however, is not limited thereto. Other methods and/or tools appreciated by one of ordinary skill in the art, even if not described in the present disclosure, may also be used In the drawings, a W direction is a first direction or a width direction, an L direction is a second direction or a length direction, and a T direction is a third direction or a thickness direction.

In the descriptions described with reference to the accompanied drawings, the same elements or elements corresponding to each other will be described using the same reference numerals, and overlapped descriptions will not be repeated.

Figure 2:
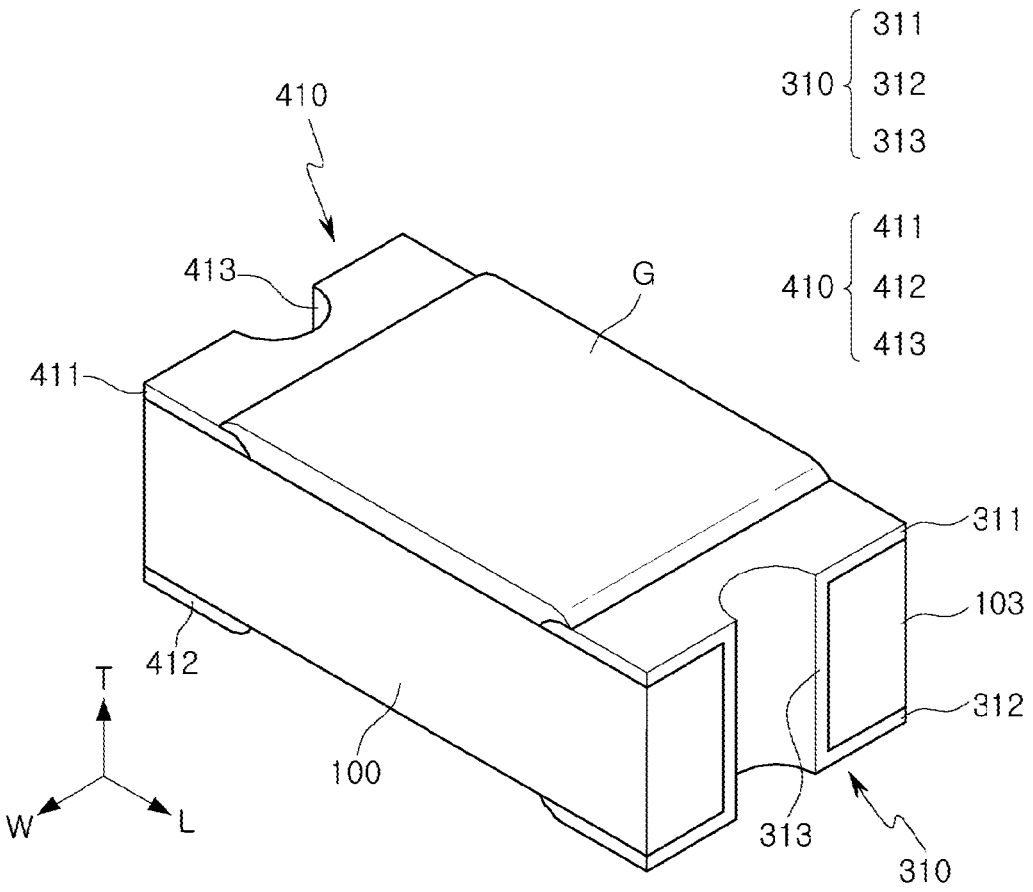
Figure 3:
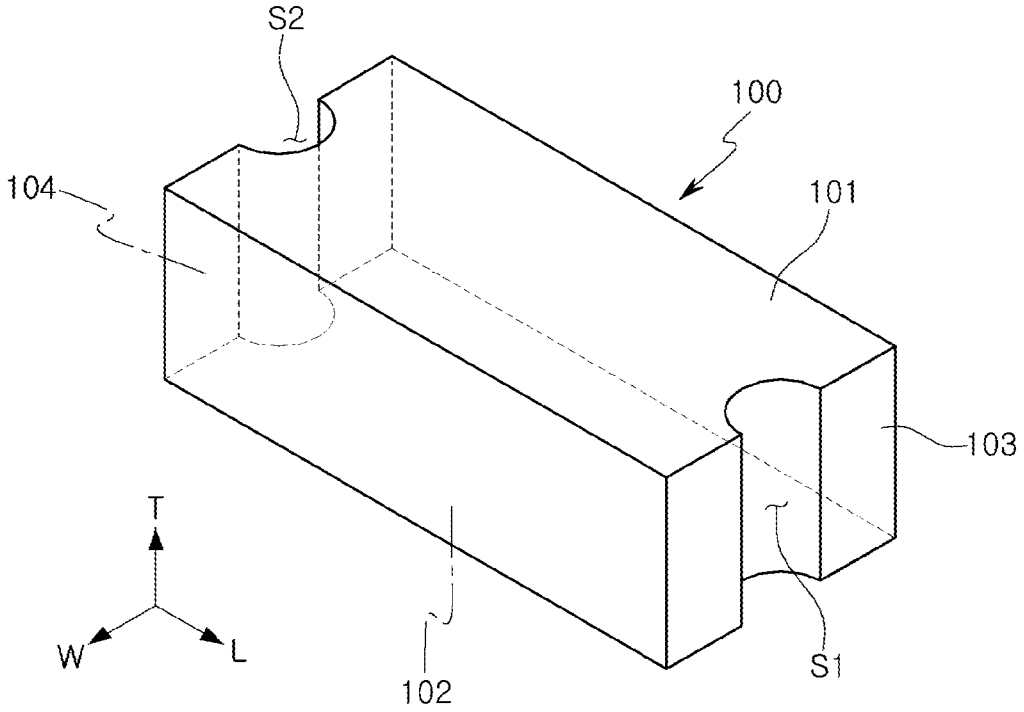
FIG. 3 is a diagram illustrating an insulating substrate applied to a resistor component according to an example embodiment of the present disclosure.
Figure 4:
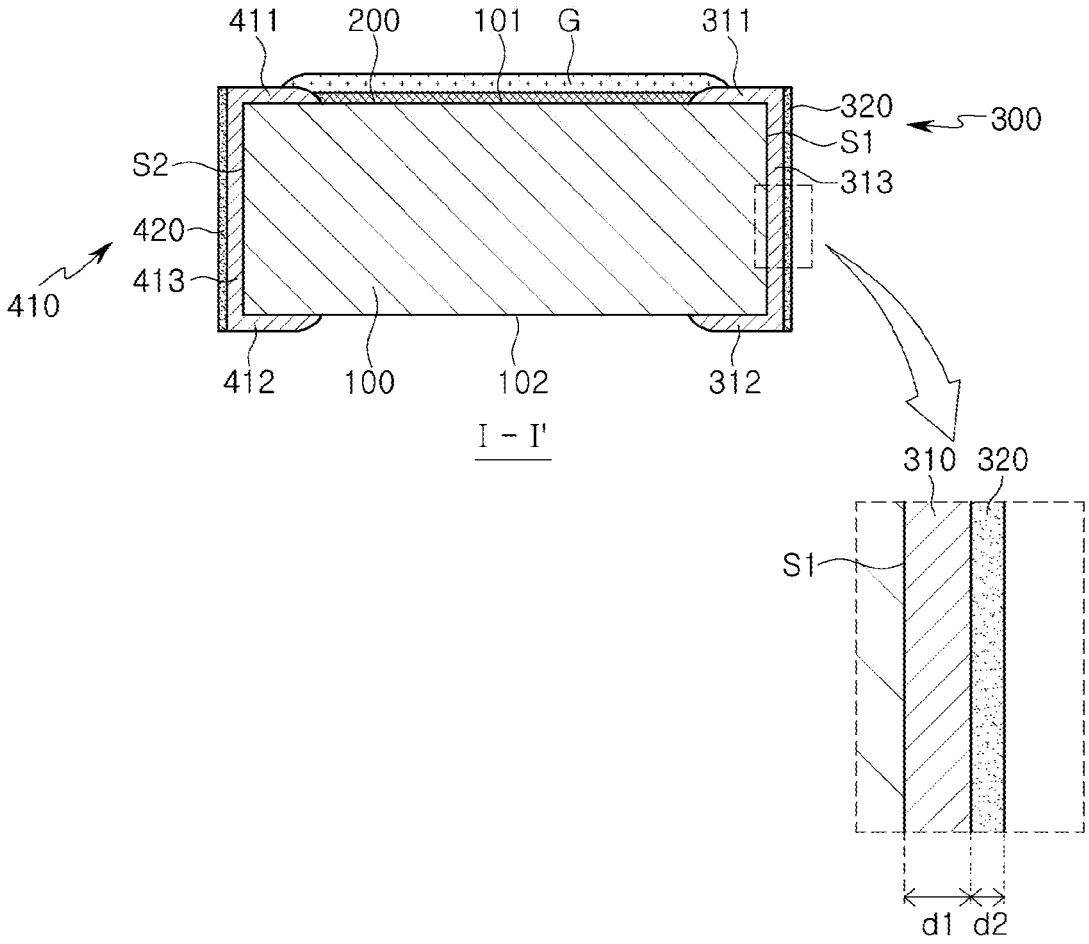
FIG. 4 is a cross-sectional diagram along line I-I' in FIG. 1.
Figure 5:
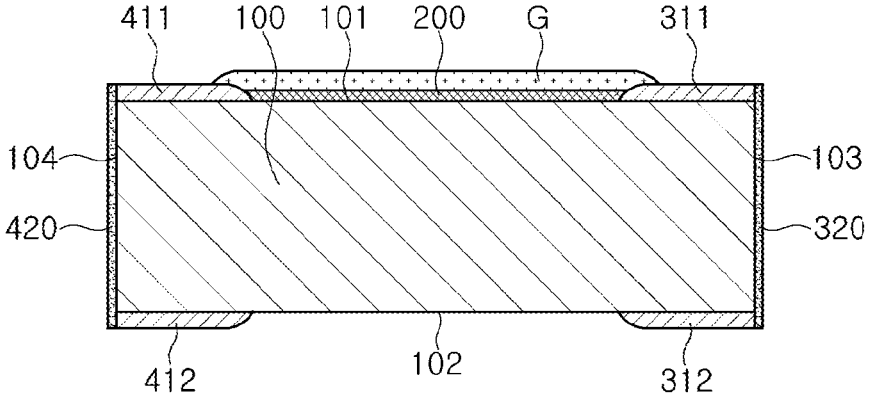
FIG. 5 is a cross-sectional diagram along line II-II' in FIG. 1.

FIGS. 1 and 2 are diagrams illustrating a resistor component according to an example embodiment. FIG. 3 is a diagram illustrating an insulating substrate applied to a resistor component according to an example embodiment. FIG. 4 is a cross-sectional diagram along line I-I' in FIG. 1. FIG. 5 is a cross-sectional diagram along line II-II' in FIG. 1. For ease of description, FIG. 2 illustrates a resistor component which does not include a portion of the elements illustrated in FIG. 1.

Referring to FIGS. 1 to 5, a resistor component 1000 in the example embodiment may include an insulating substrate 100, slit portions S1 and S2, a resistor layer 200, and first and second terminals 300 and 400.

Referring to FIG. 3, the insulating substrate 100 may have one surface 101 and the other surface 102 opposing each other, and one end surface 103 and the other end surface 104 connecting the one surface 101 and the other surface 102 to each other and opposing each other.

The insulating substrate 100 may have a plate shape having a predetermined thickness, and may include a material for effectively emitting heat generated from the resistor layer 200. The insulating substrate 100 may include a ceramic material such as alumina ($Al_2O_3$), but an example embodiment thereof is not limited thereto. The insulating substrate 100 may include a polymer material. As an example, the insulating substrate 100 may be configured as an alumina insulating substrate obtained by anodizing a surface of aluminum, but an example embodiment thereof is not limited thereto.

Referring to FIG. 3, the slit portions S1 and S2 may be formed on the one end surface 103 and the other end surface 104 of the insulating substrate 100, respectively, and may extend to the one surface 101 and the other surface 102 of the insulating substrate 100. For example, the first slit portion S1 may be disposed on the one end surface 103 of the insulating substrate 100, and the second slit portion S2 may be disposed on the other end surface 104 of the insulating substrate 100. Both ends of each of the slit portions S1 and S2 may extend to the one surface 101 and the other surface 102 of the insulating substrate 100, respectively. Internal walls of the slit portions S1 and S2 may form portions of the one end surface 103 and the other end surface 104 of the insulating substrate 100, respectively, but in the description below, the internal walls of the slit portions S1 and S2 may be distinguished from the one end surface 103 and the other end surface 104 of the insulating substrate 100 for ease of description.

The slit portions S1 and S2 may be disposed on central portions of the one end surface 103 and the other end surface 104 of the insulating substrate 100 in a width direction W, respectively. As the slit portions S1 and S2 are disposed on central portions of the one end surface 103 and the other end surface 104 of the insulating substrate 100 in the width direction W, respectively, solder, or the like, used to mount the resistor component 1000 on a printed circuit board may be stably bonded to the resistor component in the example embodiment.

Each of the slit portions S1 and S2 may have a semicircular shape with reference to an end surface in parallel to the one surface 101 of the insulating substrate 100. The slit portions S1 and S2 may be formed by processing a through-hole having a circular shaped end surface in a dicing line, a boundary between unit substrates of a large unit substrate, and separating a plurality of unit substrates by cutting out the large unit substrate along the dicing line. Accordingly, an end surface of each of the slit portions S1 and S2 formed on the one end surface 103 and the other end surface 104 of each unit substrate may have a semicircular shape. However, an example embodiment thereof is not limited thereto. A shape of the slit portions S1 and S2 may be varied according to an end surface of a hole formed in a large unit substrate.

The resistor layer 200 may be disposed on the one surface 101 of the insulating substrate 100. The resistor layer 200 may be connected to the first and second terminals 300 and 400 disposed on both end portions of the insulating substrate 100 in the length direction L and may exhibit a function of the resistor component 1000. The resistor layer 200 may have an area overlapping the first terminal 300 and the second terminal 400.

The resistor layer 200 may include a metal, a metal alloy, a metal oxide, or the like. In an example embodiment, the resistor layer 200 may include at least one of a Cu—Ni based alloy, an Ni—Cr based alloy, an Ru oxide, an Si oxide, or an Mn based alloy. The resistor layer 200 may be formed by applying a conductive paste including a metal, a metal alloy, a metal oxide, or the like, on one surface 101 of the insulating substrate 100 by a screen printing method, or the like, and sintering the paste.

FIGS. 4 and 5 illustrate an example embodiment in which the resistor layer 200 may only be disposed on the one surface 101 of the insulating substrate 100, but an example embodiment thereof is not limited thereto. As an example, although not limited thereto, the resistor layer 200 may only be disposed on the other surface 102 of the insulating substrate 100, or may be disposed on both of the one surface 101 and the other surface 102 of the insulating substrate 100. In the case of the latter, the resistor layer disposed on the one surface 101 of the insulating substrate 100 and the resistor layer disposed on the other surface 102 of the insulating substrate 100 may be connected to each other by a via penetrating the insulating substrate 100, but an example embodiment thereof is not limited thereto.

The first terminal 300 and the second terminal 400 may be disposed on the insulating substrate 100 and may oppose each other in the length direction L. The first terminal 300 and the second terminal 400 may be connected to the resistor layer 200.

The first terminal 300 and the second terminal 400 may include internal electrode layers 310 and 410 including upper electrodes 311 and 411 disposed on the one surface 101 of the insulating substrate 100, lower electrodes 312 and 412 disposed on the other surface 102 of the insulating substrate 100, and slit electrodes 313 and 413 disposed on internal walls of the slit portions S1 and S2 and connecting the upper electrodes 311 and 411 to the lower electrodes 312 and 412, respectively, and external electrode layers 320 and 420 disposed on the one end surface 103 of the insulating substrate 100, the other end surface 104 of the insulating substrate 100, and the internal walls of the slit portions S1 and S2 to cover the slit portions S1 and S2 and having a thickness less than a thickness of each of the internal electrode layers 310 and 410, respectively.

For example, the first terminal 300 may include a first internal electrode layer 310 including a first upper electrode 311 disposed on the one surface 101 of the insulating substrate 100, a first lower electrode 312 disposed on the other surface 102 of the insulating substrate 100, and a first slit electrode 313 disposed on an internal wall of the first slit portion S1, and a first external electrode layer 320 disposed on the one end surface 103 of the insulating substrate 100 and the internal wall of the first slit portion S1. The second terminal 400 may include a second internal electrode layer 410 including a second upper electrode 411 disposed on the one surface 101 of the insulating substrate 100, a second lower electrode 412 disposed on the other surface 102 of the insulating substrate 100, and a second slit electrode 413 disposed on the internal wall of the second slit portion S2, and a second external electrode layer 420 disposed on the other end surface 104 of the insulating substrate 100 and the internal wall of the second slit portion S2. In one example, the first and second external electrode layers 320 and 420 may be disposed only on the one end surface 103 and the other end surface 104, respectively, without considering a thickness of the first internal electrode layer 310 and the second internal electrode layer 410. In one example, the first and second external electrode layers 320 and 420 may not be disposed on the one surface 101 of the insulating substrate 100, and the first and second external electrode layers 320 and 420 may not be formed the other surface 102 of the insulating substrate 100. The present disclosure, however, is not limited thereto.

The internal electrode layers 310 and 410 may be formed by applying a conductive paste on the one surface 101 of the insulating substrate 100, the other surface 102 of the insulating substrate 100, and the internal walls of the slit portions S1 and S2 and sintering the paste. Accordingly, the first upper electrode 311, the first lower electrode 312, and the first slit electrode 313 included in the first internal electrode layer 310 may be integrated with one another to conform to the one surface 101 of the insulating substrate 100, the other surface 102 of the insulating substrate 100, and the internal wall of the slit portion S1. Also, the second upper electrode 411, the second lower electrode 412, and the second slit electrode 413 included in the second internal electrode layer 410 may be integrated with one another to conform to the one surface 101 of the insulating substrate 100, the other surface 102 of the insulating substrate 100, and the internal wall of the second slit portion S2. The conductive paste for forming the internal electrode layers 310 and 410 may include metal powder such as copper (Cu), silver (Ag), nickel (Ni), a binder, and a glass composition. Accordingly, the internal electrode layers 310 and 410 may include glass and metal compositions.

A thickness d1 of each of the internal electrode layers 310 and 410 may be equal to or greater than 3 μm and equal to or less than 6 μm. When the thickness d1 of each of the internal electrode layers 310 and 410 is less than 3 μm, it may not be easy to form the slit electrodes 313 and 413 in the internal walls of the slit portions S1 and S2. When the thickness d1 of each of the internal electrode layers 310 and 410 exceeds 6 μm, an overall thickness of each of the first and second terminals 300 and 400 may increase such that it may be difficult to reduce a thickness of the component.

In one example, the thickness d1 of the internal electrode layer 310 may refer to a distance from one point of a line segment corresponding to one surface of the internal electrode layer 310 (a left side surface of the internal electrode layer 310 based on the direction in FIG. 4) contacting the insulating substrate 100 to the other point at which a normal contacts a line segment corresponding to the other surface of the internal electrode layer 310, when the normal extends from one point to the other point in the length direction L, based on an optical micrograph of a longitudinal-thickness cross-section (an LT cross-section) in the central portion of the resistor component 1000 in the width direction W. The thickness d1 of the internal electrode layer 410 may be obtained similarly by the method to obtain the thickness d1 of the internal electrode layer 310.

Alternatively, based on an optical micrograph of a longitudinal-thickness cross-section (an LT cross-section) in the central portion of the resistor component 1000 in the width direction W, the thickness d1 of the internal electrode layer 310 may indicate, when normals respectively extend from a plurality of one points of a line segment corresponding to one surface of the internal electrode layer 310 (a left side surface of the internal electrode layer 310 based on the direction in FIG. 4) contacting the insulating substrate 100, an arithmetic mean of distances from the plurality of one points to a plurality of the other points at which the plurality of normals are in contact with a line segment corresponding to the other surface of the internal electrode layer 310. The thickness d1 of the internal electrode layer 410 may be obtained similarly by the method to obtain the thickness d1 of the internal electrode layer 310.

The internal electrode layers 310 and 410 may expose the one end surface 103 and the other end surface 104 of the insulating substrate 100, respectively. As the internal electrode layers 310 and 410 may be formed in a state of a large unit substrate in which the above-described through-hole is formed, the internal electrode layers 310 and 410 may not be formed on a plurality of side surfaces of a plurality of unit substrates obtained by cutting out the large unit substrate. Accordingly, the internal electrode layers 310 and 410 may not be formed on the one end surface 103 and the other end surface 104 of the insulating substrate 100 in the example embodiment.

As an example, the external electrode layers 320 and 420 may be formed by a vapor deposition method such as a sputtering process and may be formed of a metal. The external electrode layers 320 and 420 may be formed by forming a metal layer including at least one of titanium (Ti), chromium (Cr), molybdenum (Mo), and alloys thereof on the one end surface 103 and the other end surface 104 of the insulating substrate 100. Thus, the external electrode layers 320 and 420 may entirely cover each of the one end surface 103 and the other end surface 104 of the insulating substrate 100, respectively.

A thickness d2 of each of the external electrode layers 320 and 420 may be 0.07 μm or greater and 0.15 μm or less. When the thickness d2 of each of the external electrode layers 320 and 420 is less than 0.07 μm, cohesion force between the external electrode layers 320 and 420 and the one end surface 103 and the other end surface 104 of the insulating substrate 100 may decrease, and it may be difficult to form a plating electrode on the external electrode layers 320 and 420 by an electrolytic plating process. When the thickness d2 of each of the external electrode layers 320 and 420 exceeds 0.15 μm, process time and manufacturing costs may increase.

The thickness d2 of the external electrode layer 320 may refer to a distance from one point of a line segment corresponding to one surface of the external electrode layer 320 (a left side surface of the external electrode layers 320 based on the direction in FIG. 4) contacting the internal electrode layer 310 to the other point at which a normal contacts a line segment corresponding to the other surface of the external electrode layer 320, when the normal extends from one point to the other point in the length direction L, based on an optical micrograph of the longitudinal-thickness cross-section (an LT cross-section) in the central portion of the resistor component 1000 in the width direction W. The thickness d2 of the external electrode layer 420 may be obtained similarly by the method to obtain the thickness d2 of the external electrode layer 320.

Alternatively, based on an optical micrograph of the longitudinal-thickness cross-section (an LT cross-section) in the central portion of the resistor component 1000 in the width direction W, the thickness d2 of the external electrode layer 320 may indicate, when normals respectively extend from a plurality of one points of a line segment corresponding to one surface of the external electrode layer 320 (a left side surface of the external electrode layers 320 based on the direction in FIG. 4) contacting the internal electrode layer 310, an arithmetic mean of distances from the plurality of one points to a plurality of the other points at which the plurality of normals are in contact with a line segment corresponding to the other surface of the external electrode layer 320. The thickness d2 of the external electrode layer 420 may be obtained similarly by the method to obtain the thickness d2 of the external electrode layer 320.

Although not illustrated in the diagrams, the first and second terminals 300 and 400 may further include plating electrodes disposed on the upper electrodes 311 and 411, the lower electrodes 312 and 412, and the external electrode layers 320 and 420, respectively. The plating electrode may be formed by an electrolytic plating process using the upper electrodes 311 and 411, the lower electrodes 312 and 412, and the external electrode layers 320 and 420 as seed layers. As the plating electrode is formed by an electrolytic plating process using at least one of a copper plating solution, a nickel plating solution, and a tin plating solution, the plating electrode may include at least one of copper (Cu), nickel (Ni), and tin (Sn). As an example, although not limited thereto, each of the plating electrodes may include a first layer, a nickel (Ni) plated layer, and a second layer, a tin (Sn) plated layer.

A protective layer G may be disposed on a surface of the resistor layer 200 on which the first and second terminals 300 and 400 are not disposed to protect the resistor layer 200 from external impacts. As an example, although not limited thereto, a protective layer 140 may be formed of silicon ($SiO_2$) or a glass material.

The resistor component 1000 in the example embodiment may include the first and second terminals 300 and 400 each having a relatively reduced thickness, and may have improved reliability against external impacts such as vibrations, heat, or the like, such that connection reliability with a mounting substrate may be secured. For example, the first and second terminals 300 and 400 may be configured to include the internal electrode layers 310 and 410 formed on a surface of the insulating substrate 100 by a sintering process, and the external electrode layers 320 and 420 formed on the internal electrode layers 310 and 410 and a surface of the insulating substrate 100 by a vapor deposition process such as a sputtering process. As for the internal electrode layers 310 and 410, as a glass composition thereof may be chemically bonded with the insulating substrate 100 in a sintering process, cohesion force between the first and second terminals 300 and 400 and the insulating substrate 100 may improve. As the external electrode layers 320 and 420 are formed by a vapor deposition process such as a sputtering process, the external electrode layers 320 and 420 may have a reduced thickness and may be disposed on the one end surface 103 and the other end surface 104 of the insulating substrate 100 on which the internal electrode layers 310 and 410 are not disposed, and on the slit electrodes 313 and 413 of the internal electrode layers 310 and 410, and an electrolytic plating layer may be formed on the external electrode layers 320 and 420. Accordingly, an electrolytic plating layer may be formed to conform to the one end surface 103 of the insulating substrate 100, the other end surface 104 of the insulating substrate 100, and the internal walls of the slit portions S1 and S2 such that solder, or the like, for connection with a mounting substrate may be formed both of the one end surface 103 and the other end surface 104 of the insulating substrate 100.

The resistor component 1000 in the example embodiment may be manufactured by an efficient manufacturing process. For example, by forming the internal electrode layers 310 and 410 collectively on a large area substrate in which a through-hole is formed, a side surface process separately performed on a side surface of a unit substrate to connect an upper electrode to a lower electrode after a cutting out process may not be performed. Also, by collectively forming the external electrode layers 320 and 420 on exposed surfaces of a plurality of bar-shaped substrates obtained by primarily cutting out a large area substrate, the external electrode layer may be formed more efficiently as compared to a general process of forming the external electrode layer, performed after a secondary cutting out process for obtaining unit substrates.

When comparing a general process in which slit portions are not formed on one end surface and the other end surface of an insulating substrate with the example embodiment, in the example embodiment, the slit electrodes 313 and 413, sintered electrodes, may be formed along internal walls of the slit portions S1 and S2, and the external electrode layers 320 and 420 may be in contact with the slit electrodes 313 and 413, a difference from the general process. In the case of the general process, the external electrode layers 320 and 420 may only be in contact with an insulating substrate, and in this case, cohesion force between the elements may be relatively weak due to relatively low cohesion force between different materials. In the example embodiment, as the external electrode layers 320 and 420 may be in contact with the insulating substrate 100 (e.g., the one end surface 103 and the other end surface 104 of the insulating substrate 100) and may also be in contact with the slit electrodes 313 and 413 including the same material, cohesion force between the internal electrode layers 310 and 410 and the insulating substrate 100 and the external electrode layers 320 and 420 may improve.

FIGS. 6 to 12 are diagrams illustrating a method of manufacturing a resistor component according to an example embodiment.

Figure 6:
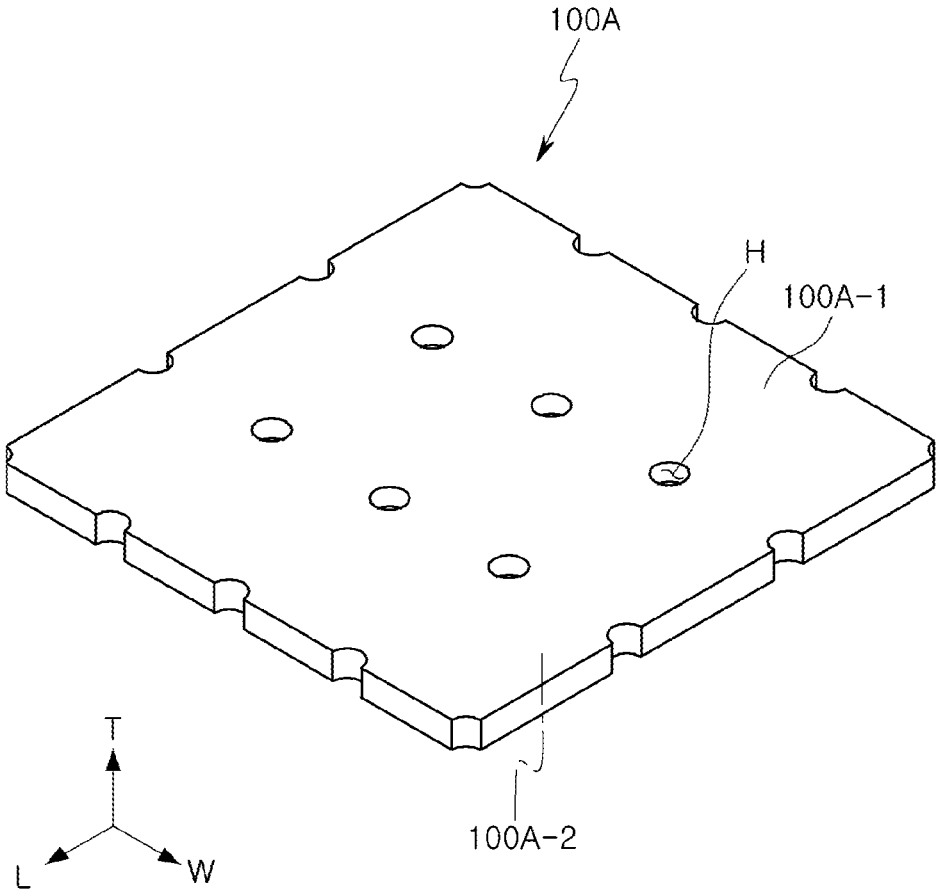
FIGS. 6 to 12 are diagrams illustrating a method of manufacturing a resistor component according to an example embodiment of the present disclosure.

Referring to FIG. 6, a base insulating substrate 100A may be prepared. The base insulating substrate 100A may have one end surface 100A-1 and the other end surface 100A-2 opposing each other, and a plurality of through-holes H penetrating the one end surface 100A-1 and the other end surface 100A-2 may be formed in the base insulating substrate 100A. Each of the plurality of through-holes H may have various shapes, such as a circular shape, an oval shape, a polygonal shape, or the like, and may be arranged in columns and rows with reference to the one end surface 100A-1 of the base insulating substrate 100A.

Figure 7:
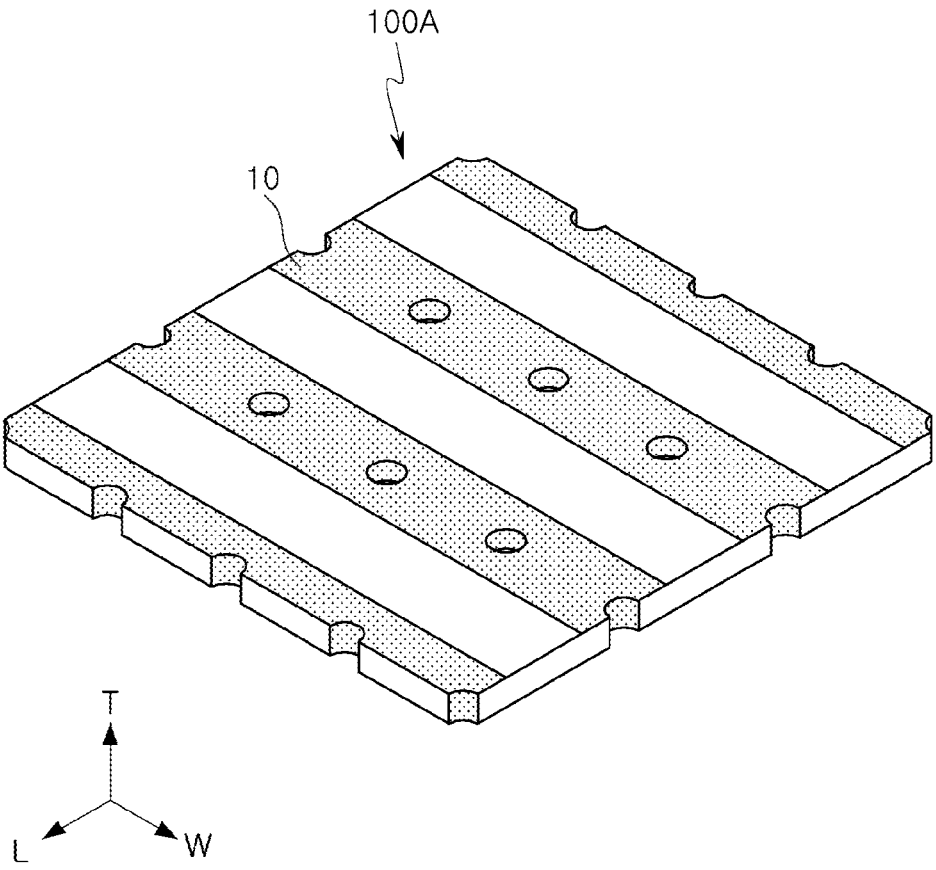

Referring to FIG. 7, a first conductive layer 10 may be formed on the one end surface 100A-1 and the other end surface 100A-2 of the base insulating substrate 100A. The first conductive layer 10 may be formed by printing a conductive paste on the one end surface 100A-1 and the other end surface 100A-2 of the base insulating substrate 100A and sintering the conductive paste. In a process of applying the conductive paste on the one end surface 100A-1 and the other end surface 100A-2 of the base insulating substrate 100A to form the first conductive layer 10, the conductive paste may also be formed on an internal wall of each of the plurality of through-holes H due to fluidity of the conductive paste. Accordingly, the first conductive layer 10 formed by sintering the conductive paste may be formed along the one end surface 100A-1 and the other end surface 100A-2 of the base insulating substrate 100A and the internal walls of the plurality of through-holes H in an integrated manner.

Figure 8:
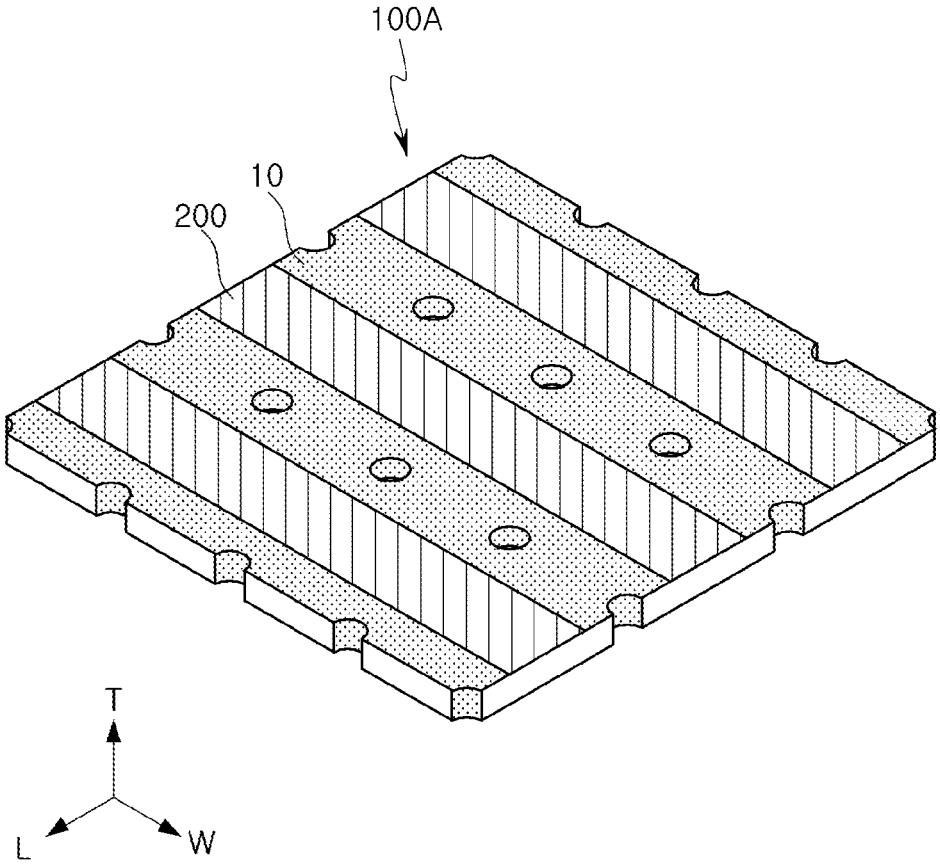

Referring to FIG. 8, a resistor layer 200 may be formed on the one end surface 100A-1 of the base insulating substrate 100A. The resistor layer 200 may be formed of at least one of a Cu—Ni based alloy, an Ni—Cr based alloy, an Ru oxide, an Si oxide, Mn, and an Mn based alloy, and may be formed by applying a paste including the above-mentioned materials by a screen printing method and baking out the paste. The resistor layer 200 may partially overlap the first conductive layer 10.

Figure 9:
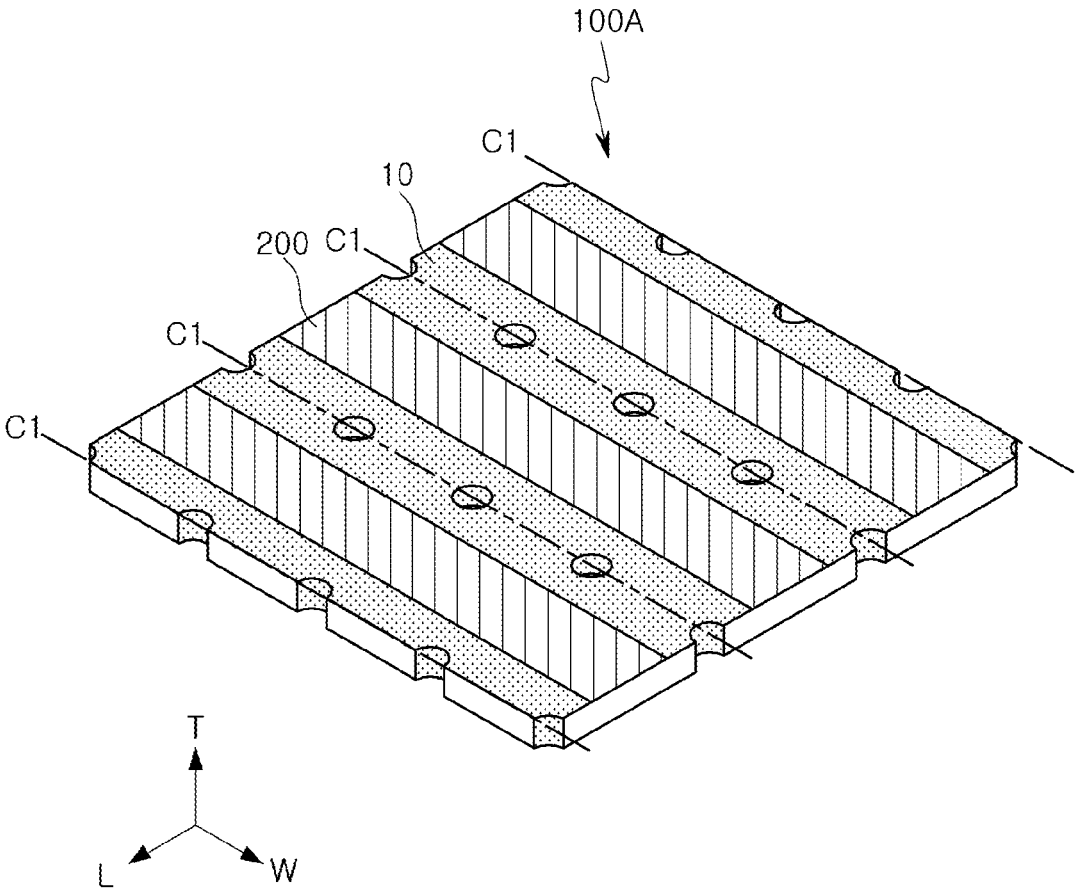
Figure 10:
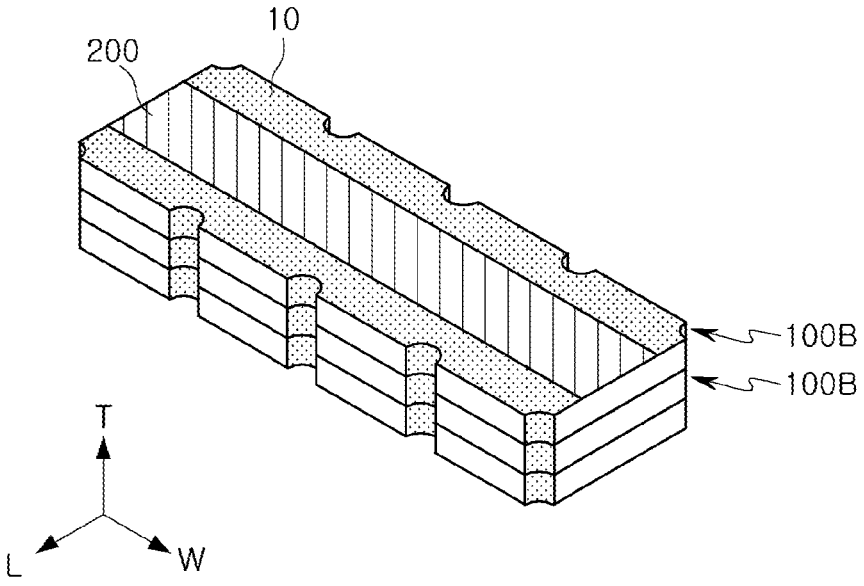

Referring to FIGS. 9 and 10, the base insulating substrate 100A may be divided into a plurality of bar-shaped substrates 100B along a conceptual divisional line C1 connecting the plurality of through-holes H to each other, and the plurality of bar-shaped substrates 100B may be stacked. As the conceptual divisional line C1 may be formed in a width direction W in FIG. 9, in the bar-shaped substrate 100B, unit substrates corresponding to individual components may be connected to each other in the width direction W of the unit substrates. Accordingly, on the level of the bar-shaped substrate 100B, one end surface and the other end surface of the unit substrate, opposing each other in the length direction L, may be externally exposed.

Figure 11:
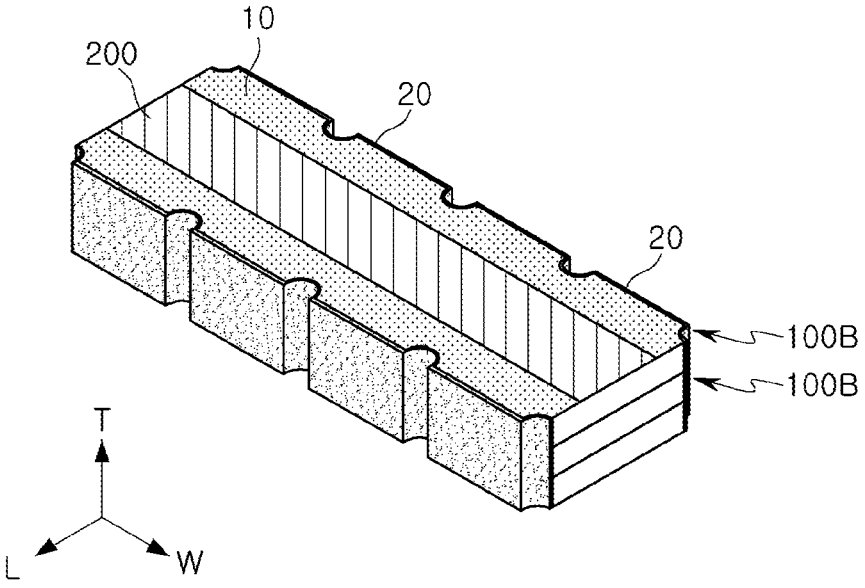

Referring to FIG. 11, a second conductive layer 20 may be disposed on one end surface and the other end surface of each of the plurality of stacked bar-shaped substrates 100B. The second conductive layer 20 may be formed by collectively handling the plurality of bar-shaped substrates 100B in a stacked state and collectively performing a vapor deposition process such as sputtering process, or the like, on the one end surface and the other end surface of each of the plurality of bar-shaped substrates 100B. In one example, in a case in which the plurality of bar-shaped substrates 100B are stacked, the second conductive layer 20 may be formed only on the one end surface and the other end surface of each of the plurality of bar-shaped substrates 100B. In other words, the second conductive layer 20 may not be formed on the surface of the plurality of bar-shaped substrates 100B on which the first conductive layer 10 and the resistor layer 200 are formed, and the second conductive layer 20 may not be formed on another surface of the plurality of bar-shaped substrates 100B opposing the surface on which the first conductive layer 10 and the resistor layer 200. The present disclosure, however, is not limited thereto.

Figure 12:
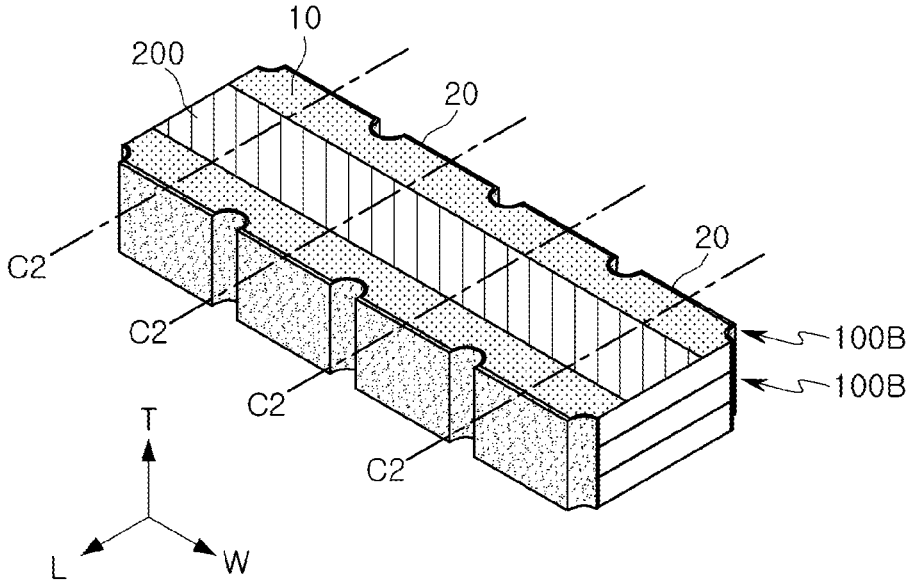

Referring to FIG. 12, the plurality of bar-shaped substrates 100B may be divided by a conceptual divisional line C2, thereby manufacturing individual components.

Although not illustrated in the diagrams, before forming the first conductive layer 10 on the base insulating substrate 100A, a process of forming a non-penetrative type scribing line in the base insulating substrate 100A along the divisional lines C1 and C2 illustrated in FIGS. 9 and 12 may also be performed. Also, FIG. 8 illustrates an example in which the first conductive layer 10 is consecutively formed on the one end surface 100A-1 of the base insulating substrate 100A in the width direction W, but an example embodiment thereof is not limited thereto. The first conductive layer 10 may be configured to be cut out in a region corresponding to the divisional line C2 in FIG. 12. Also, although not illustrated in the diagram, a trimming process for adjusting a resistance value may be performed between the process of forming the resistor layer 200 in the base insulating substrate 100A and the process of forming the plurality of bar-shaped substrates 100B by cutting out the base insulating substrate 100A along the divisional line C1, and thereafter, a process of forming the protective layer G for protecting the resistor layer 200 may also be performed. The trimming process may be a process of precisely controlling a resistance value of the resistor layer 200 by partially removing the resistor layer 200 using laser beams. The protective layer G may be formed by applying a paste including glass on the one end surface 100A-1 of the base insulating substrate 100A to cover the resistor layer 200 and sintering the paste.

According to the aforementioned example embodiments, the resistor component may have improved cohesion reliability with a mounting substrate.

Also, efficiency of a method of manufacturing a resistor component may improve.

While the exemplary embodiments have been shown and described above, it will be apparent to those skilled in the art that modifications and variations could be made without departing from the scope of the present invention as defined by the appended claims.

What is claimed is:

1. A resistor component, comprising:

an insulating substrate having one surface and the other surface opposing each other, and one end surface and the other end surface connecting the one surface and the other surface to each other and opposing each other;

first and second slit portions respectively disposed at the one end surface and the other end surface of the insulating substrate and extending to the one surface and the other surface of the insulating substrate;

a resistor layer disposed on the one surface of the insulating substrate; and a first terminal and a second terminal connected to the resistor layer, respectively, wherein the first terminal includes:

a first electrode layer including a first upper electrode disposed on the one surface of the insulating substrate, a first lower electrode disposed on the other surface of the insulating substrate, and a first slit electrode disposed on a first internal wall of the first slit portion and connecting the first upper electrode and the first lower electrode to each other; and a first external electrode layer disposed on the one end surface of the insulating substrate and the first internal wall of the first slit portion, and being in contact with the first slit electrode and the one end surface of the insulating substrate, and the second terminal includes:

a second electrode layer including a second upper electrode disposed on the one surface of the insulating substrate, a second lower electrode disposed on the other surface of the insulating substrate, and a second slit electrode disposed on a second internal wall of the second slit portion and connecting the second upper electrode and the second lower electrode to each other; and a second external electrode layer disposed on the other end surface of the insulating substrate and the second internal wall of the second slit portion, and being in contact with the second slit electrode and the other end surface of the insulating substrate.

2. The resistor component of claim 1, wherein the first and second internal electrode layers include glass and a first metal, and the first and second external electrode layers include a second metal.

3. The resistor component of claim 2, wherein the second metal includes at least one of titanium (Ti), chromium (Cr), molybdenum (Mo), or alloys thereof.

4. The resistor component of claim 2, wherein the first metal includes titanium (Ti), chromium (Cr), or molybdenum (Mo).

5. The resistor component of claim 1, wherein a thickness of the first external electrode layer or the second external electrode layer is equal to or greater than 0.07 μm and equal to or less than 0.15 μm.

6. The resistor component of claim 1, wherein the first external electrode layer covers the one end surface of the insulating substrate, and the second external electrode layer covers the other end surface of the insulating substrate.

7. The resistor component of claim 1, wherein the first upper electrode, the first lower electrode, and the first slit electrode are integrated with one another to conform to the one surface of the insulating substrate, the other surface of the insulating substrate, and the first internal wall of the first slit portion, and the second upper electrode, the second lower electrode, and the second slit electrode are integrated with one another to conform to the one surface of the insulating substrate, the other surface of the insulating substrate, and the second internal wall of the second slit portion.

8. The resistor component of claim 1, wherein the first internal electrode layer exposes the one end surface of the insulating substrate, and the second internal electrode layer exposes the other end surface of the insulating substrate.

9. The resistor component of claim 1, wherein the first slit portion is disposed in a central portion of the one end surface of the insulating substrate in a width direction, and the second slit portion is disposed in a central portion of the other end surface of the insulating substrate in the width direction.

10. The resistor component of claim 1, wherein the first slit portion and the second slit portion having have a semicircular shape with reference to the one surface of the insulating substrate.

11. The resistor component of claim 1, wherein the first external electrode layer has a thickness less than a thickness of the first internal electrode layer, and the second external electrode layer has a thickness less than a thickness of the second internal electrode layer.

12. A resistor component, comprising:

an insulating substrate having one surface and the other surface opposing each other, and one end surface and the other end surface connecting the one surface and the other surface to each other and opposing each other;

first and second slit portions disposed at the one end surface and the other end surface of the insulating substrate, respectively, and each extending to the one surface and the other surface of the insulating substrate;

a resistor layer disposed on the one surface of the insulating substrate; and a first terminal and a second terminal connected to the resistor layer, respectively, wherein the first terminal include:

a first internal electrode layer including a first upper electrode disposed on the one surface of the insulating substrate, a first lower electrode disposed on the other surface of the insulating substrate, and a first slit electrode disposed on an internal wall of the first slit portion and connecting the first upper electrode and the first lower electrode to each other; and a first external electrode layer disposed on the one end surface of the insulating substrate and covering the first slit electrode, the second terminal include:

a second internal electrode layer including a second upper electrode disposed on the one surface of the insulating substrate, a second lower electrode disposed on the other surface of the insulating substrate, and a second slit electrode disposed on an internal wall of the second slit portion and connecting the second upper electrode and the second lower electrode to each other; and a second external electrode layer disposed on the other end surface of the insulating substrate and covering the second slit electrode, among the one surface of the insulating substrate, the other surface of the insulating substrate, and the one end surface of the insulating substrate, the first external electrode layer is disposed on only the one end surface of the insulating substrate, and among the one surface of the insulating substrate, the other surface of the insulating substrate, and the other end surface of the insulating substrate, the second external electrode layer is disposed on only the other end surface of the insulating substrate.

13. The resistor component of claim 12, wherein the first and second internal electrode layers include glass and a first metal, and the first and second external electrode layers include a second metal.

14. The resistor component of claim 13, wherein the second metal includes at least one of titanium (Ti), chromium (Cr), molybdenum (Mo), or alloys thereof.

15. The resistor component of claim 13, wherein the first metal includes titanium (Ti), chromium (Cr), or molybdenum (Mo).

16. The resistor component of claim 12, wherein a thickness of one of the first and second external electrode layers is equal to or greater than 0.07 μm and equal to or less than 0.15 μm.

17. The resistor component of claim 12, wherein the first slit electrode is disposed on only the internal wall of the first slit portion, and the second slit electrode is disposed on only the internal wall of the second slit portion.

18. The resistor component of claim 12, wherein the first external electrode layer is in contact with the one end surface of the insulating substrate, and the second external electrode layer is in contact with the other end surface of the insulating substrate.

19. A resistor component, comprising:

an insulating substrate having one surface and the other surface opposing each other, and one end surface and the other end surface connecting the one surface and the other surface to each other and opposing each other;

first and second slit portions respectively disposed at the one end surface and the other end surface of the insulating substrate and extending to the one surface and the other surface of the insulating substrate;

a resistor layer disposed on the one surface of the insulating substrate; and a first terminal and a second terminal connected to the resistor layer, respectively, wherein the first terminal includes:

a first electrode layer including a first upper electrode disposed on the one surface of the insulating substrate, a first lower electrode disposed on the other surface of the insulating substrate, and a first slit electrode disposed on a first internal wall of the first slit portion and connecting the first upper electrode and the first lower electrode to each other; and a first external electrode layer disposed on the one end surface of the insulating substrate and the first internal wall of the first slit portion and being in contact with the first slit electrode, the first external electrode layer including a portion disposed inside the first slit portion, and the second terminal includes:

a second electrode layer including a second upper electrode disposed on the one surface of the insulating substrate, a second lower electrode disposed on the other surface of the insulating substrate, and a second slit electrode disposed on a second internal wall of the second slit portion and connecting the second upper electrode and the second lower electrode to each other; and a second external electrode layer disposed on the other end surface of the insulating substrate and the second internal wall of the second slit portion and being in contact with the second slit electrode, the second external electrode layer including a portion disposed inside the second slit portion.

20. The resistor component of claim 19, wherein the first and second internal electrode layers include glass and a first metal, and the first and second external electrode layers include a second metal.

* * * * *